US005316161A

United States Patent [19]

Gargione

[11] Patent Number: 5,316,161

[45] Date of Patent: May 31, 1994

[54] CHILD RESISTANT CLOSURE

[75] Inventor: Frank V. Gargione, Egg Harbor, N.J.

[73] Assignee: Comar, Inc., Buena, N.J.

[21] Appl. No.: 48,509

[22] Filed: Apr. 20, 1993

[51] Int. Cl.[5] ..... B65D 55/02

[52] U.S. Cl. ..... 215/220

[58] Field of Search ..... 215/206, 217, 220

[56] References Cited

U.S. PATENT DOCUMENTS

| | | | |
|---|---|---|---|
| 3,756,444 | 9/1973 | McIntosh | 215/220 |
| 3,797,688 | 3/1974 | Porcelli et al. | 215/220 |
| 4,527,701 | 7/1985 | Schaubeck | 215/220 |
| 4,632,264 | 12/1986 | Evans . | |
| 4,673,095 | 6/1987 | Puresevic et al. | 215/220 |
| 5,005,718 | 4/1991 | Buono | 215/220 |
| 5,020,681 | 6/1991 | Kusz | 215/220 |

FOREIGN PATENT DOCUMENTS

| | | | |
|---|---|---|---|
| 463073 | 11/1972 | Australia | 215/220 |

*Primary Examiner*—Allan N. Shoap
*Assistant Examiner*—Stephen Cronin
*Attorney, Agent, or Firm*—Brady, O'Boyle & Gates

[57] ABSTRACT

A child resistant closure having an inner cap and an outer cap. The inner cap is normally biased into engagement with the outer cap for screwing the closure onto the container but the outer cap and inner cap become disengaged when the outer cap is turned in a direction to remove the closure from the container resulting in the outer cap being freely rotatable on the inner cap. Cooperating rigid fingers and teeth are provided on the inner and outer caps which become engaged when the outer cap is pushed downwardly to interconnect the inner and outer caps so that the closure can be removed from the container.

2 Claims, 2 Drawing Sheets

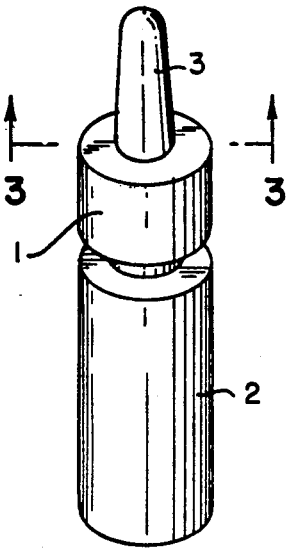
FIG. 1
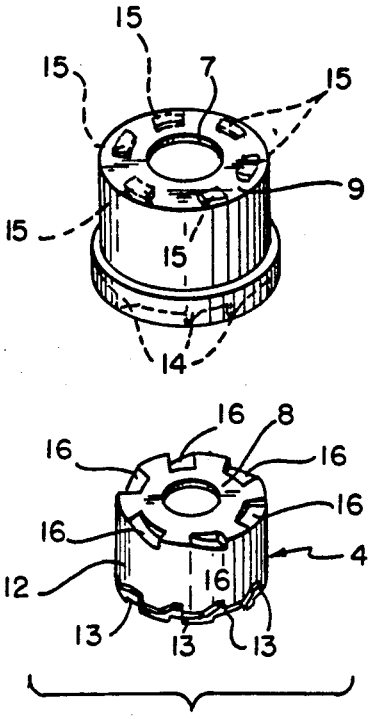
FIG. 2
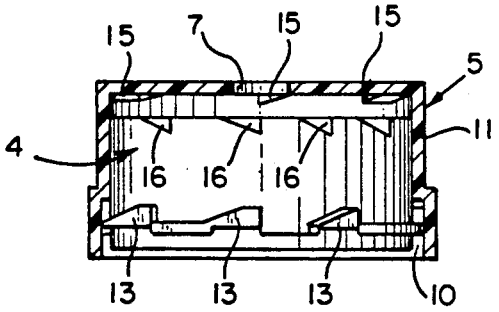
FIG. 3
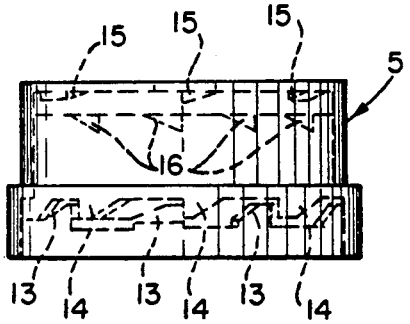
FIG. 4
FIG. 5
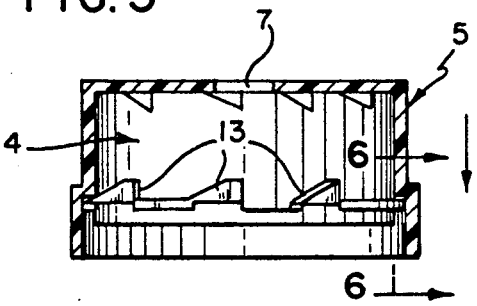
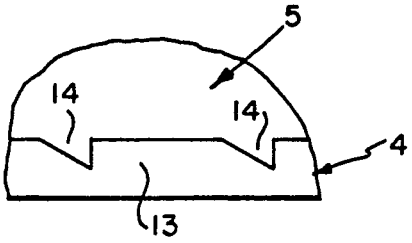
FIG. 6

CHILD RESISTANT CLOSURE

BACKGROUND OF THE INVENTION

Various child resistant closures for medicine bottles have been devised to prevent or at least resist the access to the contents of the medicine bottle by children. One such closure includes an inner cap threadably mounted on the medicine bottle and an outer cap freely rotatable on the inner cap when an attempt is made to remove the closure from the bottle. A plurality of spring fingers extend between the top walls of the inner and outer caps to keep the caps spaced from each other, whereby the outer cap is freely rotatable on the inner cap. Cooperating teeth or lugs are provided on the inner and outer caps which become interconnected when the outer cap is pushed downwardly, whereby the closure can be unscrewed from the bottle.

While these child resistant closures have been satisfactory for their intended purpose, they have been subject to a certain disadvantage in that it is necessary to not only push the outer cap downwardly when removing the closure from the bottle but also when threading the closure back onto the bottle. Oftentimes, the manipulation of the outer cap is not accomplished resulting in the closure being merely placed on the bottle in an unsafe manner.

To facilitate the replacement of a two-piece child resistant closure on a medicine bottle without sacrificing the child resistant feature of the closure, the child resistant closure of the present invention has been devised.

SUMMARY OF THE INVENTION

The child resistant closure of the present invention comprises, essentially, an inner cap having internal threads for connection to the threaded neck of a medicine bottle, and an outer cap rotatably mounted on the inner cap. Each of the caps has a depending skirt portion. A plurality of resilient flexible fingers are provided on the lower peripheral portion of the inner skirt and engageable with a plurality of cooperating teeth provided on the skirt of the outer cap. The biasing force in the resilient flexible fingers causes the fingers to engage the teeth on the outer cap skirt whereby the inner and outer caps are normally interconnected when screwing the closure onto the bottle neck; however, the resilient flexible fingers merely engage and slide over the teeth when the outer cap is turned in a direction to remove the closure from the bottle, whereby the outer cap rotates relative to the inner cap.

The bottom surface of the top wall of the outer cap has a plurality of rigid fingers engageable with cooperating rigid teeth provided on the top surface of the top wall of the inner cap. The outer cap is normally spaced upwardly from the inner cap by the biasing force of the resilient flexible fingers, whereby the outer cap is freely rotatable on the inner cap. To unscrew the closure from the bottle, the outer cap is pushed downwardly against the biasing force of the the flexible fingers to thereby interconnect the rigid fingers and teeth, whereby the outer cap is connected to the inner cap.

By the construction and arrangement of the closure of the present invention, it is only necessary to push the outer cap downwardly when removing the closure from the bottle, while the biasing force of the resilient fingers automatically causes the fingers to engage the outer cap skirt teeth to interconnect the inner and outer caps when screwing the cap onto the bottle; thereby precluding the necessity of pushing the outer cap downwardly when screwing the closure onto the bottle.

BRIEF DESCRIPTION OF THE DRAWINGS

FIG. 1 is a perspective view of the closure of the present invention mounted on a medicine bottle;

FIG. 2 is an exploded view of the closure showing the inner and outer caps;

FIG. 3 is a view taken along line 3—3 of FIG. 1;

FIG. 4 is a side elevational view of the closure;

FIG. 5 is a sectional side elevational view of the closure showing the outer cap pushed downwardly toward the inner cap for removing the closure from the bottle;

FIG. 6 is a view taken along line 6—6 of FIG. 5;

DESCRIPTION OF THE PREFERRED EMBODIMENT

Figure 7:
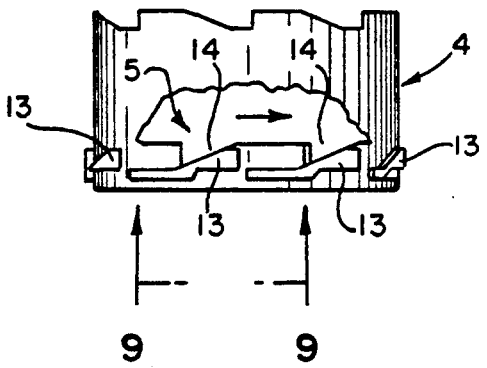
FIGS. 7 and 8 are fragmentary side elevational views showing the flexible fingers on the inner cap skirt flexing during the turning of the outer cap in a direction to unscrew the closure from the bottle.

Referring to the drawings and more particularly to FIGS. 1 to 3, the child resistant closure 1 of the present invention is adapted to be threadably secured to the neck of a medicine bottle 2 which can include a dropper having a bulb actuator 3 extending through the closure 1. The closure 1 comprises an internally threaded inner cap 4, and an outer cap 5 having aligned openings 6 and 7 in their top walls 8 and 9, respectively, through which the bulb actuator 3 extends. For use with medicine bottles not employing droppers, it will be understood that the top walls 8 and 9 of the inner and outer caps 4 and 5 will be continuous; that is, aligned openings will not be provided therein.

Figure 8:
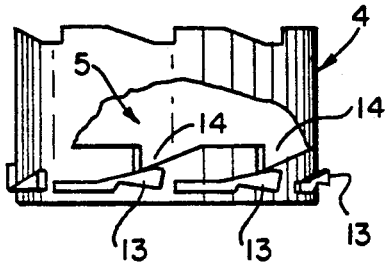
Figure 9:
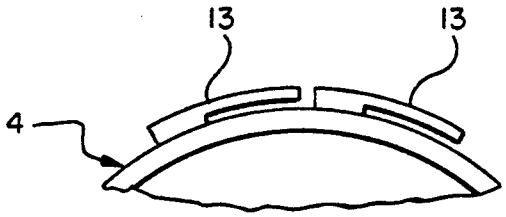
FIG. 9 is a view taken along line 9—9 of FIG. 7.

The outer cap 5 is rotatably mounted on the inner cap 4 which is held within the outer cap 5 by an annular bead 10 provided on the inner surface of lower peripheral edge of the skirt 11 of the outer cap 5. The inner cap 4 also has a skirt portion 12, and a plurality of resilient flexible fingers 13 are provided on the outer surface of the lower peripheral edge of the skirt 12. The resilient flexible fingers 13 are engageable with a plurality of cooperating teeth 14 provided on the inner surface of the lower peripheral edge of the skirt 11 of the outer cap 5. The biasing force on the flexible fingers 13 causes the fingers 13 to engage the teeth 14 as shown in FIG. 4, whereby the inner and outer caps 4 and 5 are normally interconnected when screwing the closure 1 onto the bottle 2; however, as shown in FIGS. 7 and 8, the teeth 14 engage the resilient flexible fingers 13 which flex vertically with respect to the inner cap skirt portion 12 so that the teeth 14 merely slide over the fingers 13 in a ratcheting manner when the outer cap 5 is turned in a direction to remove the closure 1 from the bottle 2, whereby the outer cap 5 rotates relative to the inner cap 4.

In order to interconnect the inner cap 4 and outer cap 5 for removal of the closure I from the bottle 2, as will be seen in FIGS. 2 and 3, the bottom surface of the top wall 9 of the outer cap 5 has a plurality of rigid fingers 15 engageable with cooperating rigid teeth 16 provided on the top surface of the top wall of the inner cap 4. The outer cap 5 is normally spaced upwardly from the inner cap 4 by the biasing force of the flexible fingers 13 as shown in FIGS. 3 and 4, whereby the outer cap 5 is freely rotatable on the inner cap 4 when turned in a direction to remove the closure 1 from the bottle 2. To unscrew the closure 1 from the bottle 2, the outer cap 5 is pushed downwardly against the biasing force of the flexible fingers 13, to thereby interconnect the rigid fingers 15 and teeth 16, whereby the outer cap 5 is connected to the inner cap 4 as shown in FIG. 5.

From the above description, it will be appreciated by those skilled in the art that an improved child resistant closure is provided by the closure of the present invention in that it is only necessary to push the outer cap 5 downwardly when removing the closure 1 from the bottle 2, while the biasing force of the resilient fingers 13 on the inner cap 4 automatically causes the fingers 13 to engage the teeth 14 on the outer cap 5 to interconnect the inner and outer caps when screwing the closure 1 onto the bottle 2.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A child resistant closure comprising, an inner cap threadably connected to a container, an outer cap rotatably mounted on said inner cap, each cap having a top wall and a depending skirt portion, a plurality of resilient flexible fingers provided on the outer peripheral surface of the inner cap skirt along the lower edge portion thereof said flexible fingers being flexible in a vertical direction only with respect to the inner cap skirt, a plurality of teeth provided on the inner peripheral surface of the outer cap skirt along the lower edge portion thereof, a portion of the resilient flexible fingers being normally biased into engagement with a portion of said teeth, to thereby connect the inner cap with the outer cap for screwing the closure onto the container, another portion of the teeth engaging another portion of the resilient flexible fingers, to thereby cause the fingers to flex vertically with respect to the inner cap skirt portion to move the resilient flexible fingers out of engagement with the teeth when the outer cap is turned in a direction to remove the closure from the container, whereby the outer cap is freely rotatable on the inner cap, and means operatively connected between the inner and outer caps for interconnecting the caps when the closure is turned in a direction to remove the closure from the container.

2. A child resistant closure according to claim 1, wherein the means operatively connected between the inner and outer caps for removing the closure from the container comprises, a plurality of rigid fingers on the bottom surface of the top wall of the outer cap, and a plurality of rigid teeth on the top surface of the top wall of the inner cap, the top wall of the outer cap being normally spaced upwardly from the inner cap by the biasing force of the resilient flexible fingers, whereby the outer cap is freely rotatable on the inner cap when the outer cap is turned in a direction to remove the closure from the container, said outer cap being movable downwardly to engage the rigid fingers thereon with the rigid teeth on the inner cap to thereby interconnect the inner and outer caps, whereby the closure can be removed from the container.

* * * * *